US012569778B2

(12) United States Patent
Kocking

(10) Patent No.: US 12,569,778 B2
(45) Date of Patent: Mar. 10, 2026

(54) FLYING DISC(S) WITH HANDLE

(71) Applicant: Evans Walter Abarzua Kocking, Aurora, CO (US)

(72) Inventor: Evans Walter Abarzua Kocking, Aurora, CO (US)

( * ) Notice: Subject to any disclaimer, the term of this patent is extended or adjusted under 35 U.S.C. 154(b) by 298 days.

(21) Appl. No.: 18/340,695

(22) Filed: Jun. 23, 2023

(65) Prior Publication Data

US 2024/0424421 A1 Dec. 26, 2024

(51) Int. Cl.

| | |
|---|---|
| ***F41B 3/04*** | (2006.01) |
| ***A63H 33/18*** | (2006.01) |
| ***F41F 7/00*** | (2006.01) |
| ***F41J 9/28*** | (2006.01) |
| *A63F 9/02* | (2006.01) |

(52) U.S. Cl.

CPC ..... *A63H 33/18* (2013.01); *F41B 3/04* (2013.01); *F41F 7/00* (2013.01); *F41J 9/28* (2013.01); *A63F 2009/0286* (2013.01)

(58) Field of Classification Search

CPC ..... F41B 3/00; F41B 3/04; F41J 9/28; A63H 33/18

See application file for complete search history.

(56) References Cited

U.S. PATENT DOCUMENTS

| | | | | |
|---|---|---|---|---|
| 1,164,609 | A * | 12/1915 | Darton | F41B 3/04 473/505 |
| 2,586,547 | A * | 2/1952 | Marley | F41J 9/28 124/43 |
| 2013/0174818 | A1* | 7/2013 | Tingey | F41J 9/28 124/5 |
| 2015/0136101 | A1* | 5/2015 | Jensen | F41J 9/28 124/5 |

* cited by examiner

*Primary Examiner* — John A Ricci

(74) *Attorney, Agent, or Firm* — Leyendecker & Lemire, LLC

(57) ABSTRACT

This invention is a type of flying disc. It has very special features that makes it unique and an innovation. To the flying disc part one can add a handle, thus, making it a flying disc with a handle protruding downwards from the center of the flying disc part. To this flying disc with a handle, one can add many features like: an overhang, a dome, lights, sound devices, solar panels, computer, buttons, light sensors, speakers, TV screen, meteorological instruments, remote control, drone capabilities, flaps, wings, propellers, etc. Also, this flying disc with a handle rotates like a top on various surfaces. Thus, it is a flying disc and a top in one. To the flying disc with a handle, one can add or take off parts, like extensions, handle, and flying disc parts to create bigger or more interesting flying discs, as shown in the drawings.

13 Claims, 22 Drawing Sheets

FLYING DISC(S) WITH HANDLE

BACKGROUND

The flying disc or Frisbee was invented by an American inventor, Walter Frederick Morrison, in 1948. Fred Morrison and his wife liked to play by throwing upside-down cake pans to each other on the beaches of California. Throwing cake or pie pans was not new, but Fred Morrison had the idea to make a plastic version. The original Frisbee called the flying saucer was introduced in 1948 by Fred Morrison.

DETAILED DESCRIPTION

Figure 1:
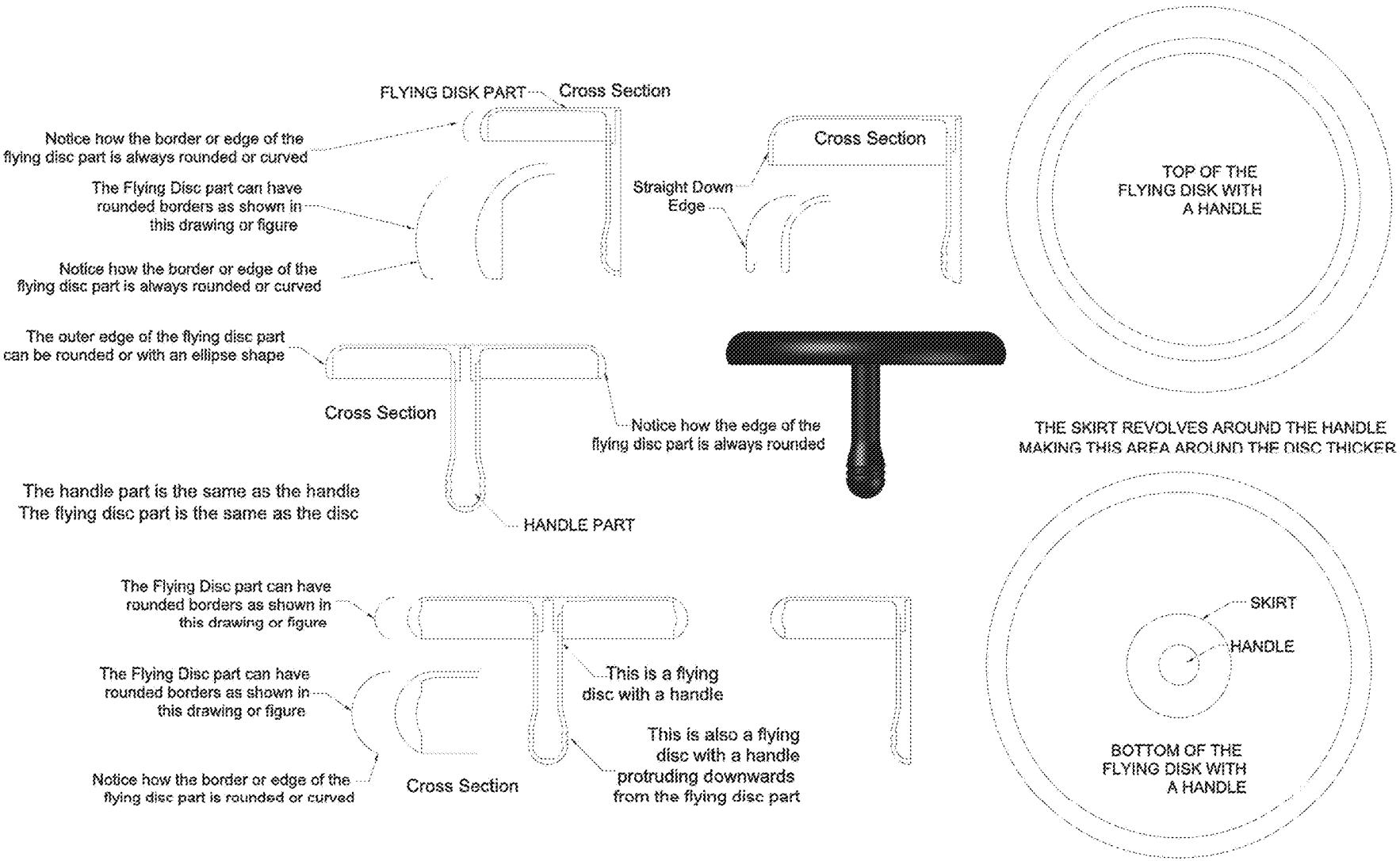
FIG. 1 includes several views of flying disks according to one or more embodiments of the present invention.

I Just want to make clear that these specifications are for a flying disc with a handle protruding downwards from the center of the flying disc part. Also, in my specifications when I talk about a flying disc with a handle is the same as a flying disk with a handle protruding downwards from the flying disc part. Also, disc and disk are the same. Handle is the same as handle part, and flying disc is the same as flying disc part. The cross sections once revolved around, creates a complete flying disc with a handle protruding downwards from the flying disc part. This is a flying disc composed of a flying disc part and a handle part. Embodiments also include a machine (or apparatus) that can throw, sling, pitch, or shoot these flying discs with handles.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase’s case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “directly coupled” or “coupled directly,” as used in this specification and appended claims, refers to a physical connection between identified elements, components, or objects, in which no other element, component, or object resides between those identified as being directly coupled.

The term “approximately,” as used in this specification and appended claims, refers to plus or minus 10% of the value given.

The term “about,” as used in this specification and appended claims, refers to plus or minus 20% of the value given.

The terms “generally” and “substantially,” as used in this specification and appended claims, mean mostly, or for the most part.

Directional and/or reflationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

EMBODIMENTS OF A FLYING DISC WITH A HANDLE

Referring to FIG. 1, these drawings show that the flying disc part can have rounded edges or rounded borders, as shown in FIG. 1. Here we can also see that the rounded borders or rounded edges can have different curvatures and different sizes. We can also see that the edge can be rounded. Furthermore, we can compare the rounded edges to the straight down edge of the flying disc part. The cross sections once revolved around, creates a complete flying disc with a handle protruding down from the flying disc part. Furthermore, in FIG. 1 we can see that the bottom of the flying disc with a handle has a skirt around the handle part. This part of the flying disc can be thicker in order to reinforce the connection between the handle part and the flying disc part. Also, this skirt can be nice for looks. We can see in the cross sections that this part can be thicker. The skirt revolves around the handle making the area around the disc part thicker.

Figure 2:
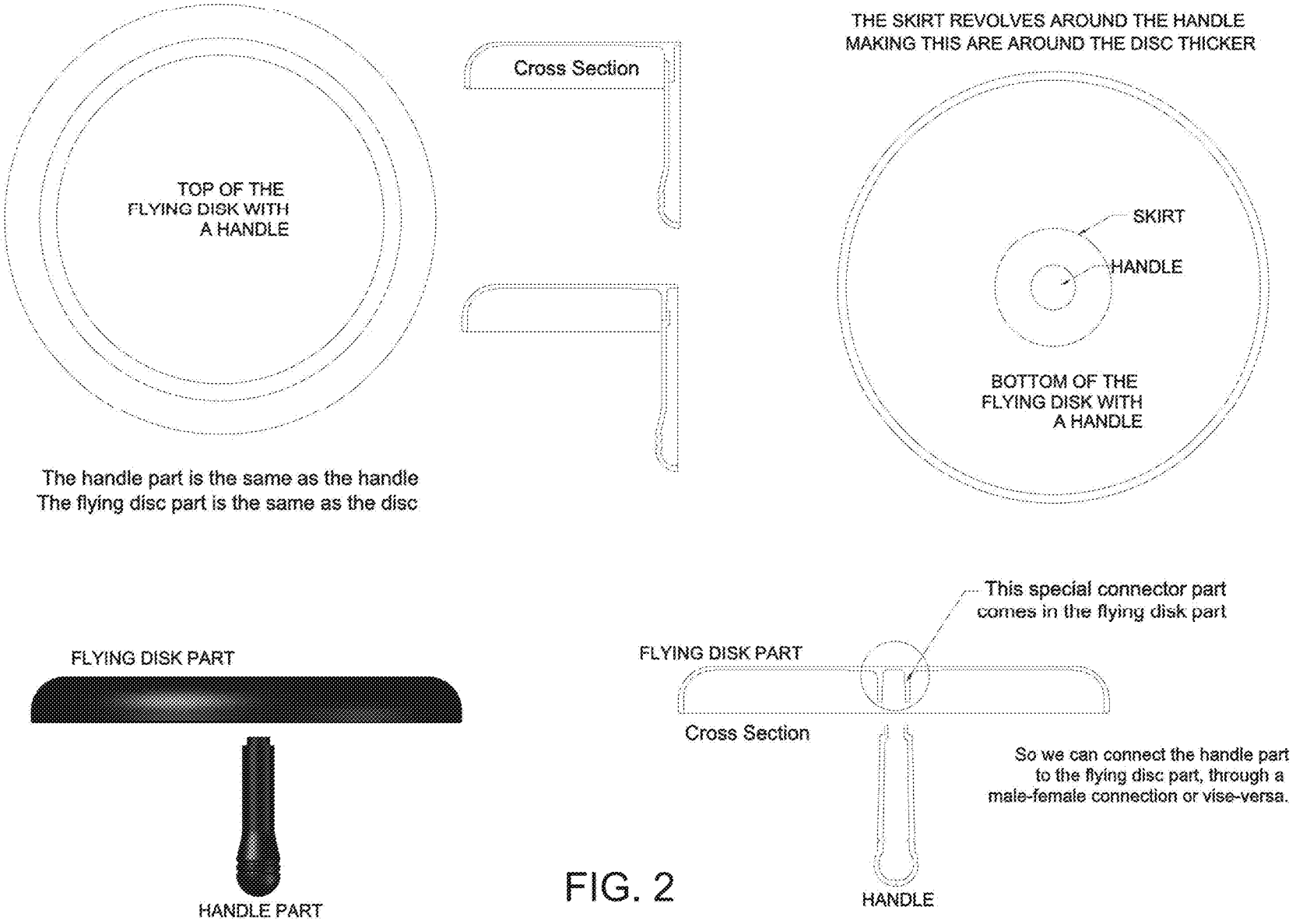
FIG. 2 includes several views of flying disks according to one or more embodiments of the present invention.

Referring to FIG. 2, these drawings show that the flying disc part has a special connector part where the handle goes into this connector part. This connector part can be part of the flying disc with a handle. Thus, when manufactured this special connector part comes in the flying disc part. For this reason, this flying disc part can be a special type of disc part because it has this special connector part. The handle part also has a special connector part that when connected to the flying disc part creates a flying disc with a handle protruding downwards from the center of the flying disc part. This figure also shows the skirt that goes around the handle on the flying disc part.

Figure 3:
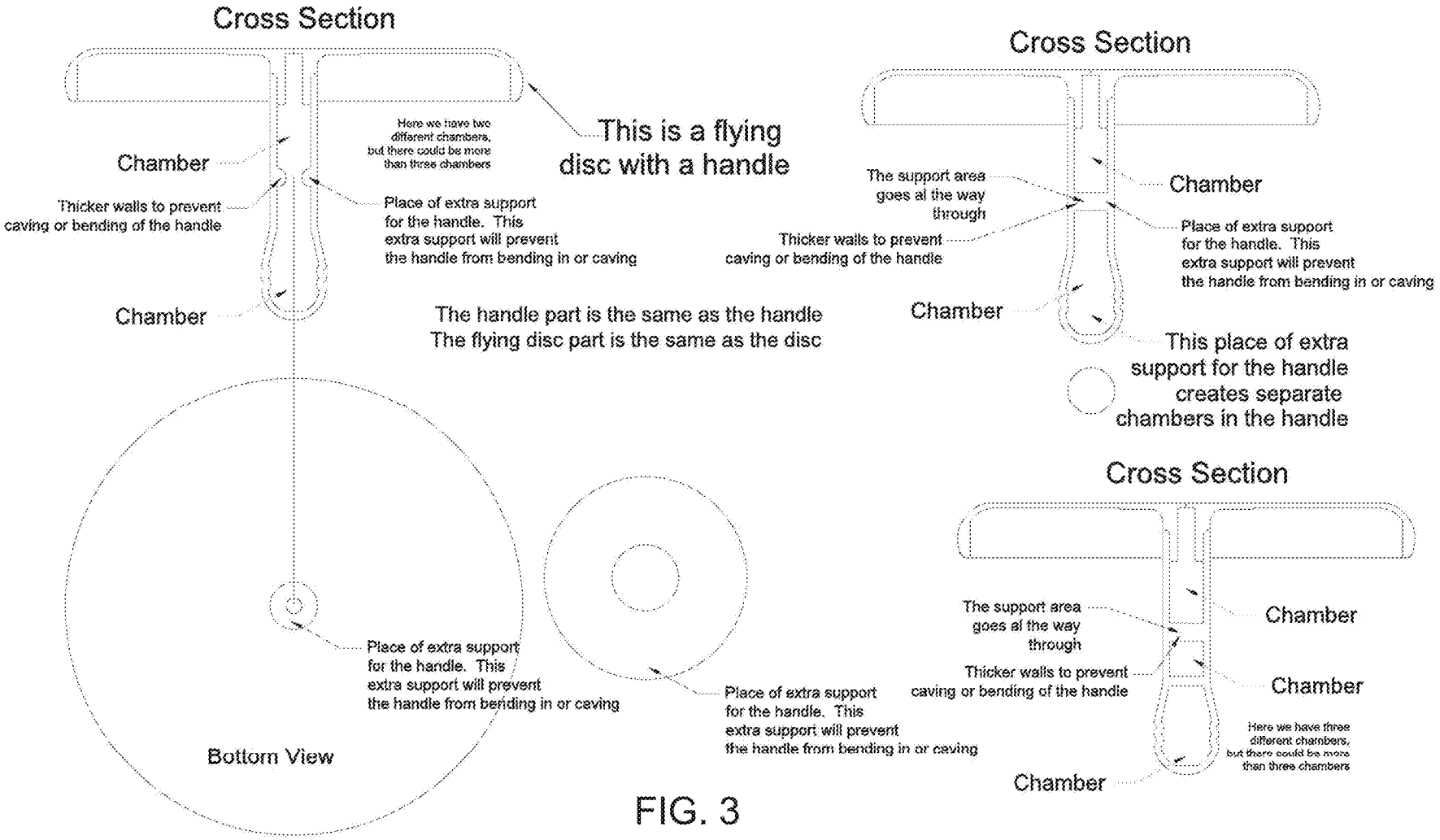
FIG. 3 includes several views of flying disks according to one or more embodiments of the present invention.

Referring to FIG. 3, these drawings show a place of extra support in the handle part. This place of extra support for the handle will prevent the handle walls from bending in or caving in when firmly held by a hand. Adding thicker handle wall at this point prevents caving in and also creates different chambers in the handle part. We can see that by adding thicker walls we can creates chambers in handle. The handle can have chambers. FIG. 1 shows thicker walls in the handle that create chambers with a connection between chambers. So, there can be a place of extra support in the handle that creates chambers that are connected. Also, FIG. 1 shows a support area in the handle that goes all the way through, which creates chambers that are not connected to each other. We have in FIG. 1 for the handle two chambers that are connected to each other, two chambers that are not connected to each other, and three chambers that are not connected to each other. It is to be appreciated that there could be more than three chambers.

Figure 4:
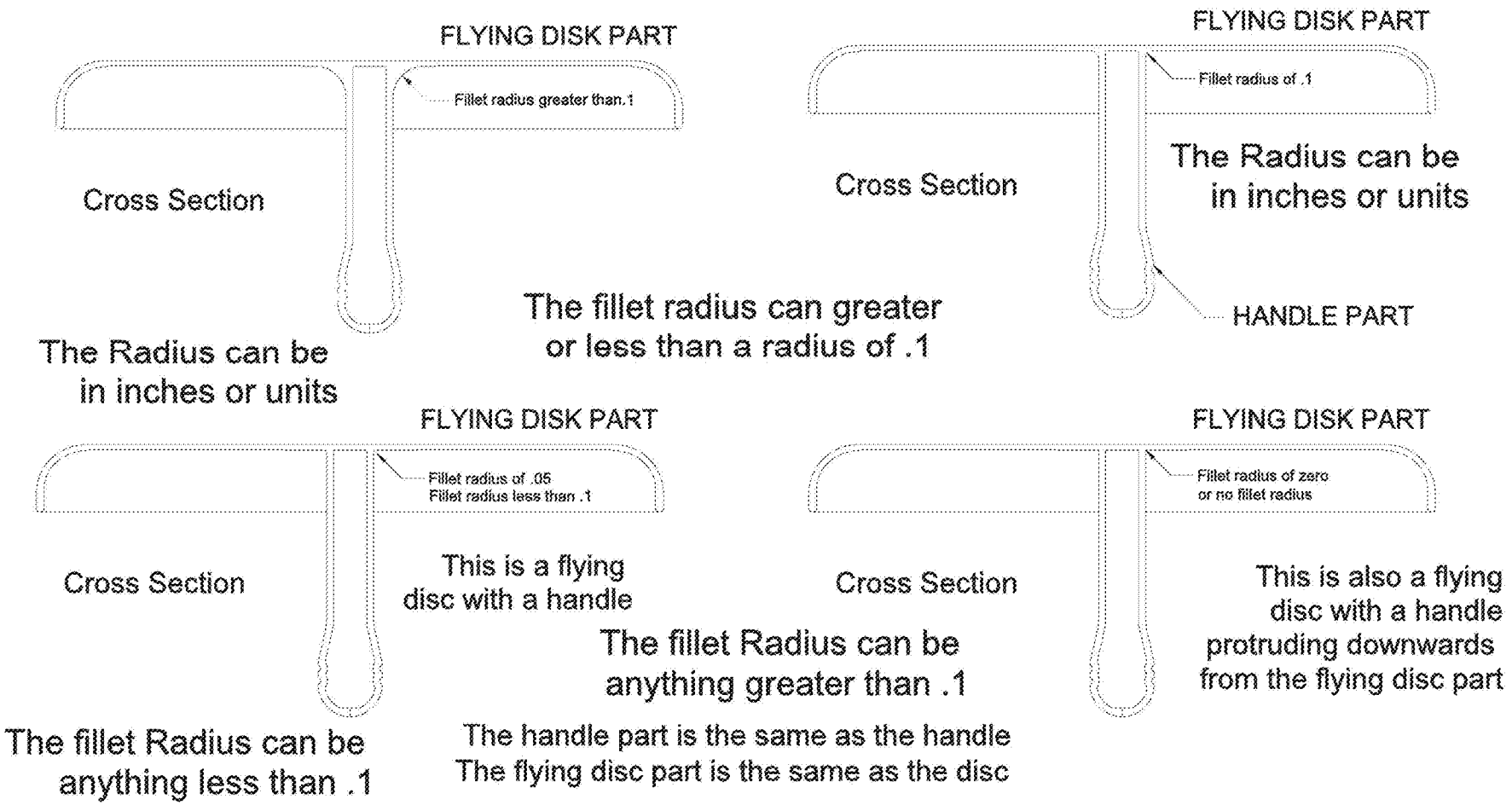
FIG. 4 includes several views of flying disks according to one or more embodiments of the present invention.

Referring to FIG. 4, these drawings show that that the fillet radius where the handle part meets the flying disc part can be less than 0.1 and greater than 0.1. The fillet radius can be anything less than 0.1. Also, the fillet radius can be anything greater than 0.1 inches or units. Thus, the fillet radius can be greater than 0.1 inches in size. Also, the fillet radius can be less than 0.1 inches in size. Furthermore, the fillet radius can be zero. This fillet radius is very important because it gives more strength where the handle part meets the flying disc part.

Figure 5:
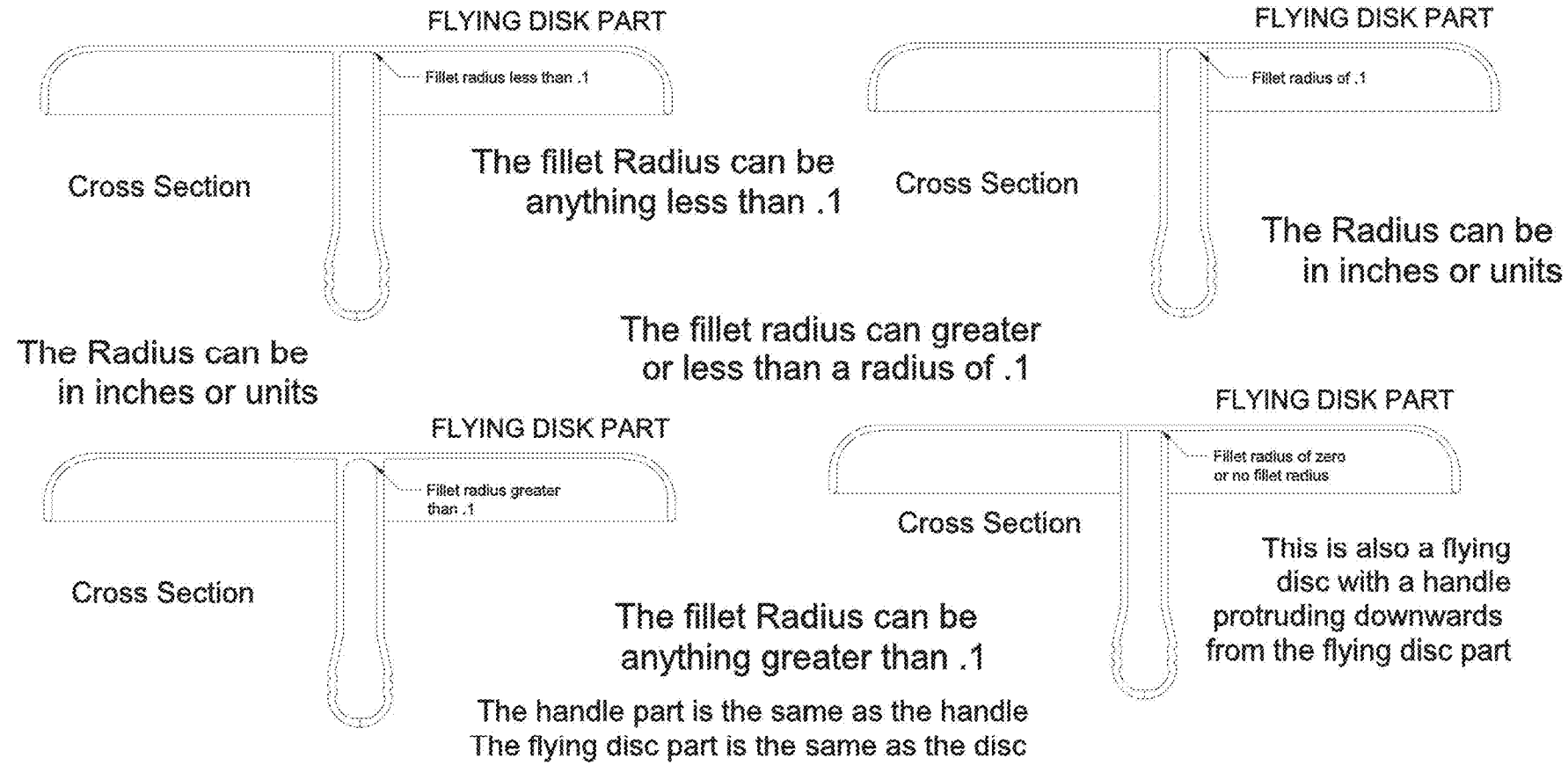
FIG. 5 includes several views of flying disks according to one or more embodiments of the present invention.

Referring to FIG. 5, these drawings show that the fillet radius inside the handle, where the handle meets the flying disc part, can be less or greater than 0.1 inches or units. Thus, the fillet radius where the handle part meets the flying disc part can be greater than 0.1 inches in size. Furthermore, the fillet radius where the handle part meets the flying disc part can be less than 0.1 inches in size. Also, this fillet radius can be zero.

Figure 6:
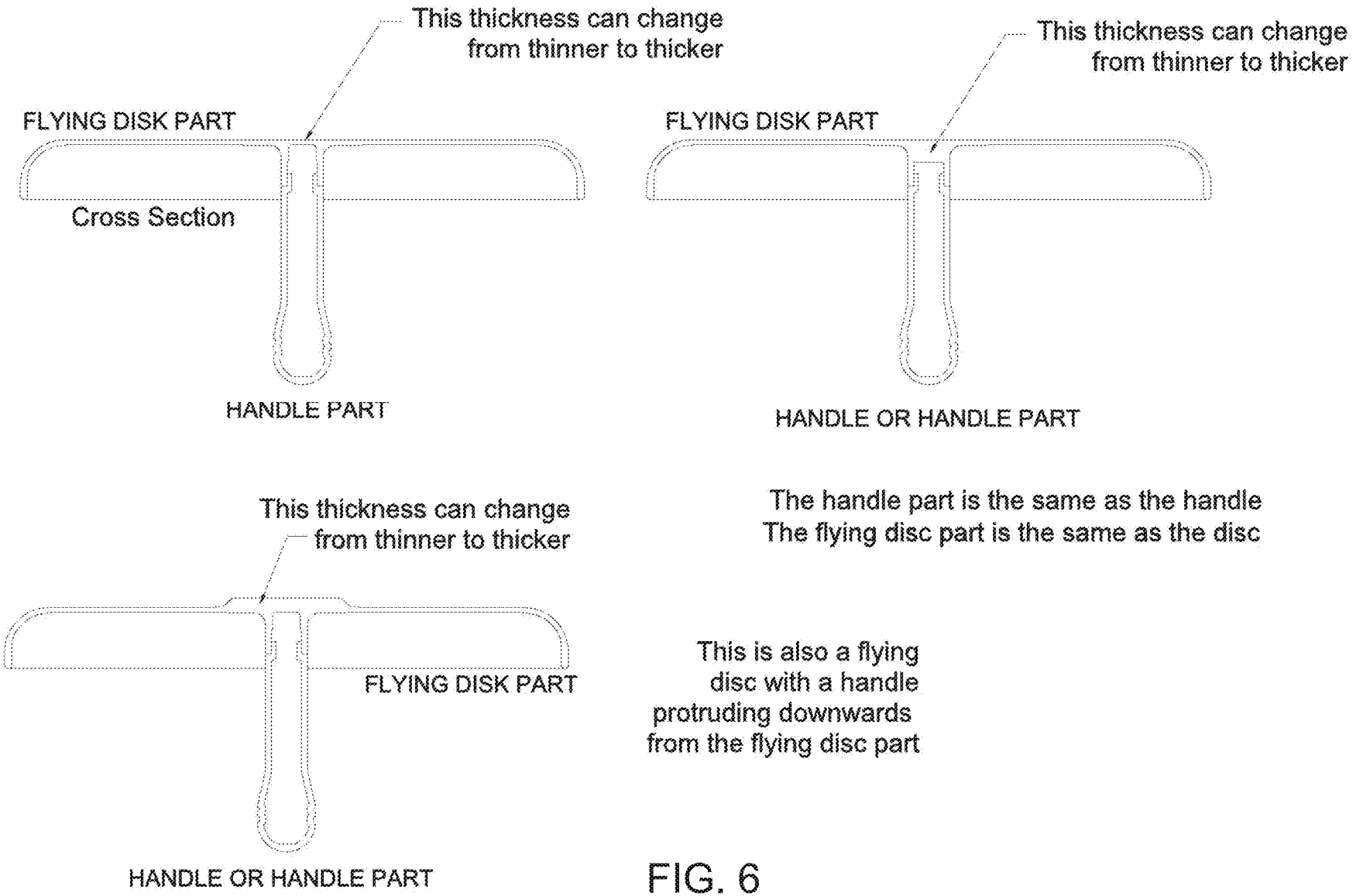
FIG. 6 includes several views of flying disks according to one or more embodiments of the present invention.

Referring to FIG. 6, these drawings show that the thickness of the wall of the flying disc part can be thicker close to where the handle part mates with the flying disc part. The wall of the flying disc part can be thicker going downwards. Also, this thickness can change from thinner to thicker. Thus, the flying disc part can become thicker at its center. Also, the flying disc part can become thinner at its center. Furthermore, the wall of the flying disc part can become thicker going upwards from the center of the flying disc part. So, the center of the flying disc part can become thicker or thinner, going up or down. Thus, the center of the flying disc part wall can become thicker or thinner. The walls of the flying disc part center can become thicker. The walls of the flying disc part center can become thinner.

Figure 7:
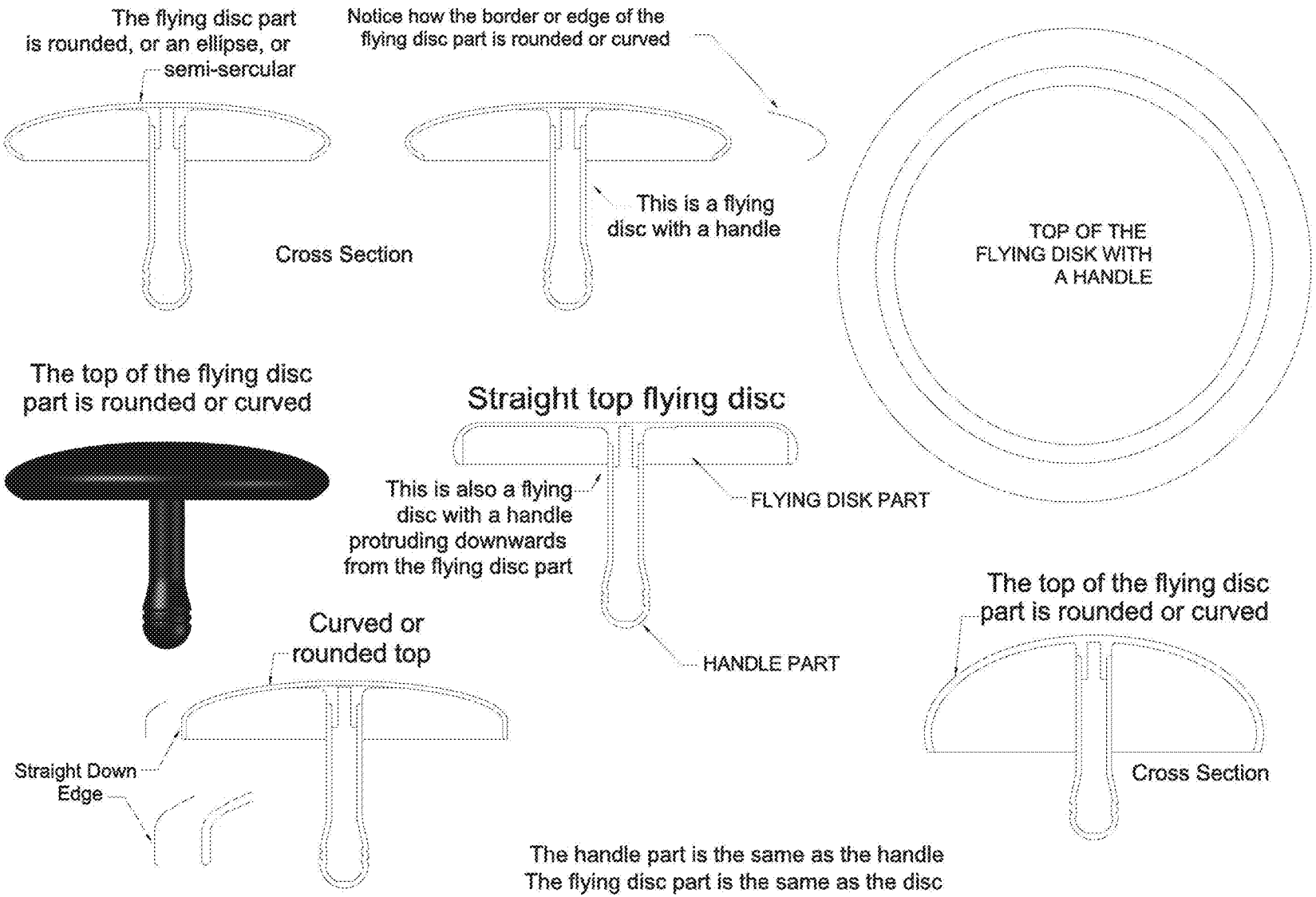
FIG. 7 includes several views of flying disks according to one or more embodiments of the present invention.

Referring to FIG. 7, these drawings show that the flying disc with a handle can have a flying disc part that can be curved or rounded. Thus, this flying disc with a handle protruding downwards from the center of the flying disc part, can have a flying disc part that can be curved. The flying disc part can be rounded. The flying disc part can be curved. Compared to a straight top flying disc, this flying disc with a handle has a top that can be curved. The curvature of the flying disc part can change. Thus, the flying disc part top can have a curvature that can change. The curvature of the flying disc part can change from more to less curvature. There can be a flying disc part very curved. There can be a flying disc part that can be less curved. The top of the flying disc part can be rounded. And, it can be more rounded or less rounded. There can be flying discs with handles that have a flying disc top that very curved. There can be flying discs with handles that have a flying disc top that can be less curved. So, the top of the flying disc part can be curved.

Figure 8:
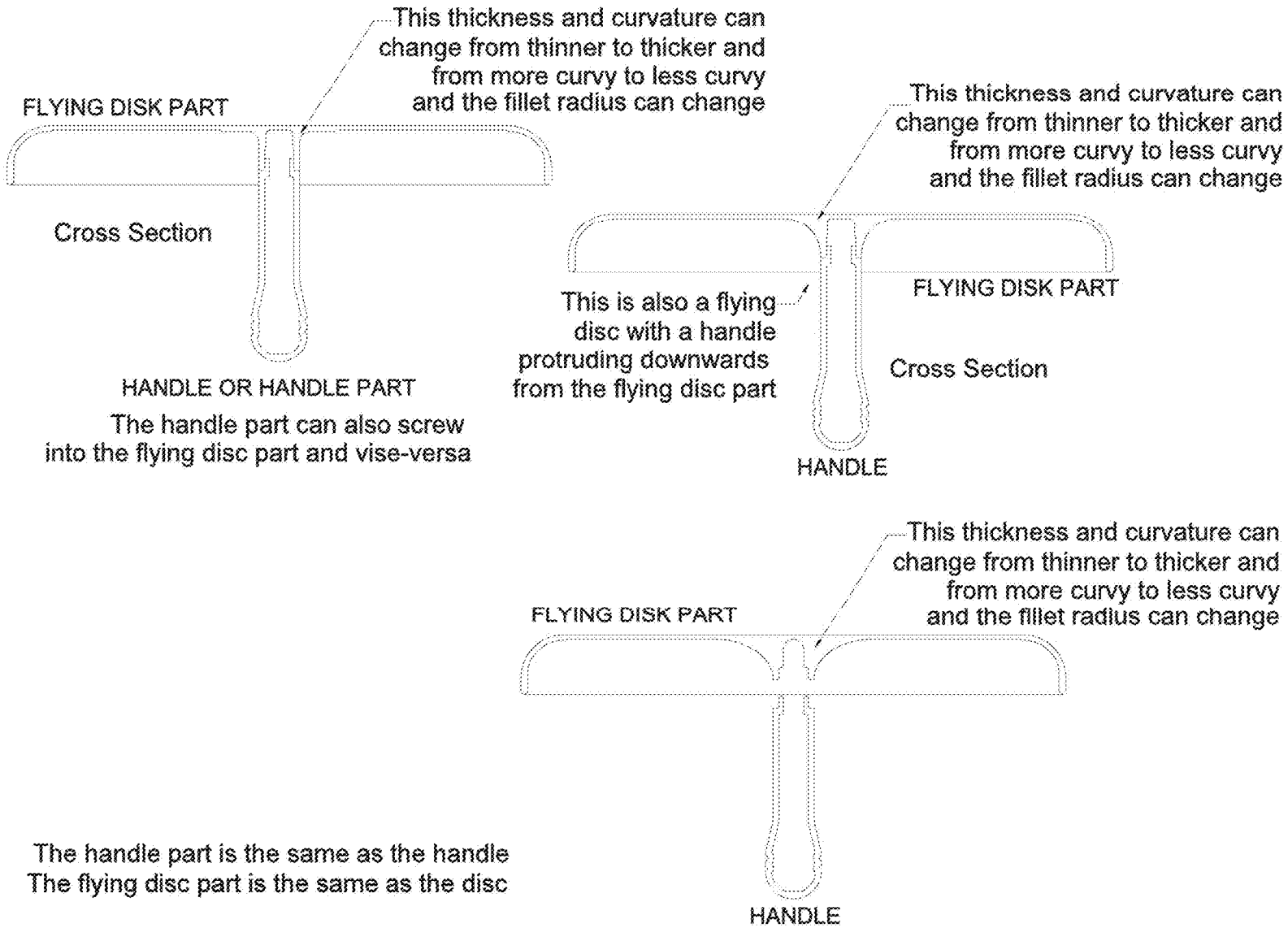
FIG. 8 includes several views of flying disks according to one or more embodiments of the present invention.

Referring to FIG. 8, these drawings show that the curvature of the special connector on the flying disc part can change. This curvature can change from curvier to less curvy. Also, the thickness of this area can change from thinner to thicker. Thus, this area on the flying disc part can be thick. The thicker this area, the stronger it can be and the less flexible the flying disc with a handle becomes. This area can be thin, making the flying disc with a handle more flexible. The curvature in this area of the flying disc part can be more or less curvy as shown in FIG. 8. In this figure we can read that the handle part can also screw into the flying disc part and vise-versa.

Figure 9:
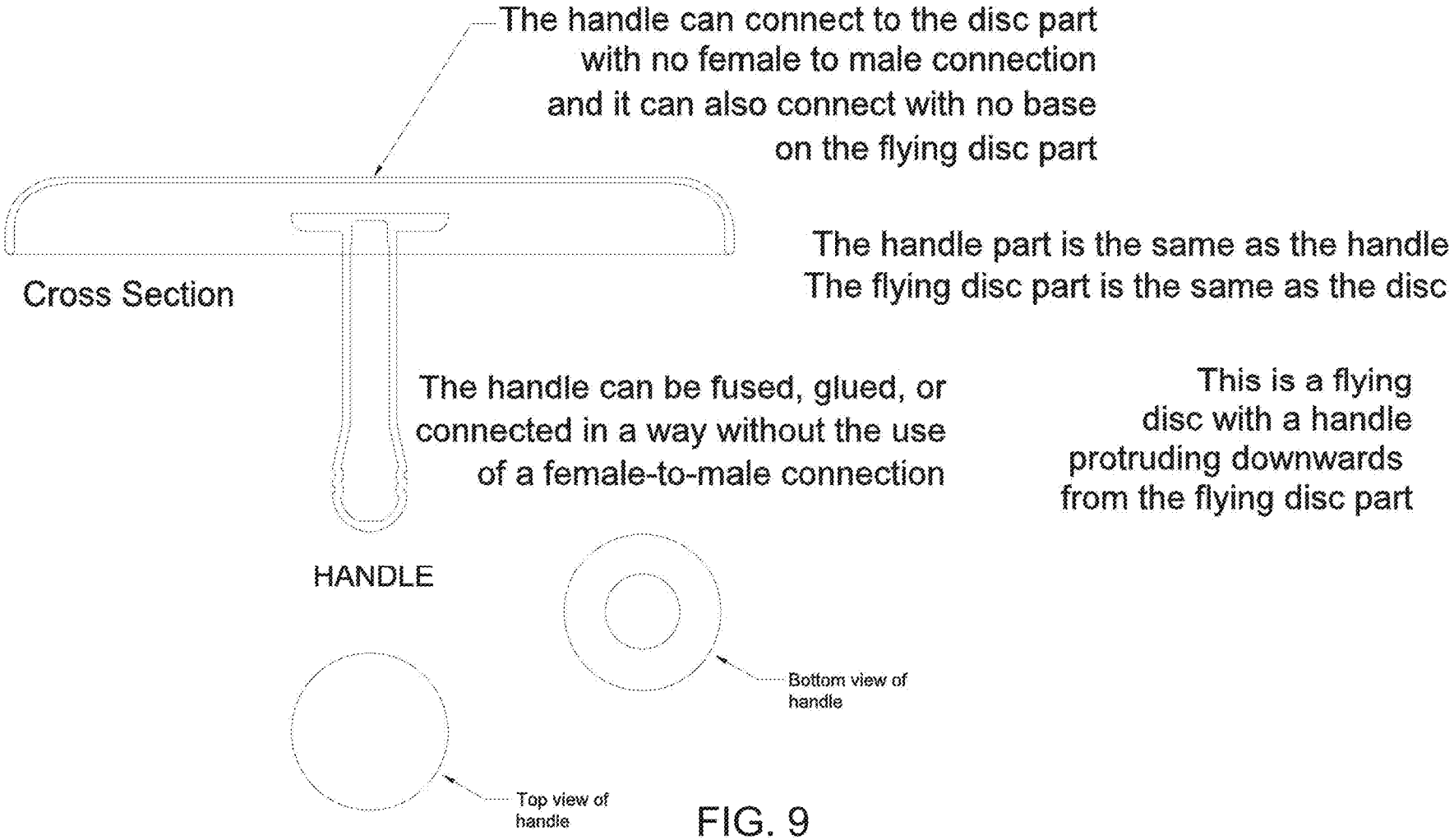
FIG. 9 includes several views of flying disks according to one or more embodiments of the present invention.

Referring to FIG. 9, these drawings show that the flying disc part connects to the handle part with no male-to-female connection. The handle part can be fused, glued, or connected in a way that does not use male-to-female connection. It can also connect without a base on the flying disc part. Also notice that the handle part has a base to connect to the flying disc part. The handle part can also connect to the flying disc part with no base on the handle part. Also, you can see that the top of the handle can be flat. The top view of the handle can be circular. The bottom view of the handle can be circular. The top view of the handle can be flat across. The skirt can be on the handle part. The skirt can be on the handle and not on the flying disc part. The flying disc part does not have a base or special connector to connect to the handle. The flying disc part can be flat at its center. The flying disc part does not have a connector at its center. The inner fillet can be on the handle part.

Figure 10:
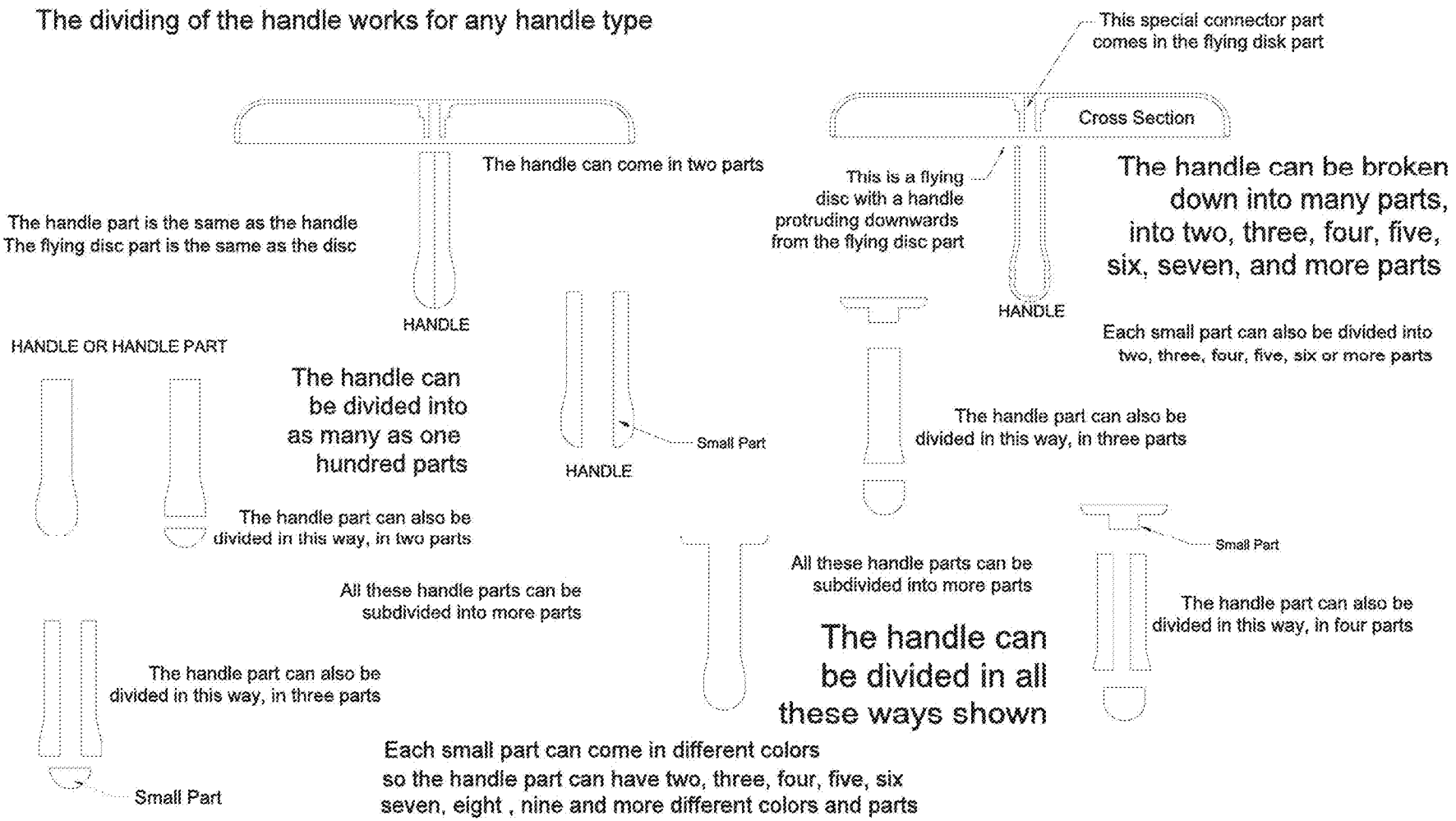
FIG. 10 includes several views of flying disks according to one or more embodiments of the present invention.

Referring to FIG. 10, these drawings show that the handle for the flying disc with a handle can be divided in many different ways. The handle can be divided in two ways. The handle can be divided in three ways. The handle can be divided in four ways. The handle can be divided into two parts, three parts, and four parts. The handle can be divided into as many as one hundred parts. The handle can be divided in all the ways shown in FIG. 10. All these handle parts can be subdivided into more parts. Each small part can come in different colors, so the handle can have two, three, four, five, six, seven, eight, nine, and more different colors and parts. The handle can be divided into two equal parts. The handle can be broken down into many parts, into two, three, four, five, six, seven, and more parts. The handle with the base can also be broken down into different parts. Each small part can be subdivided into more parts.

Figure 11:
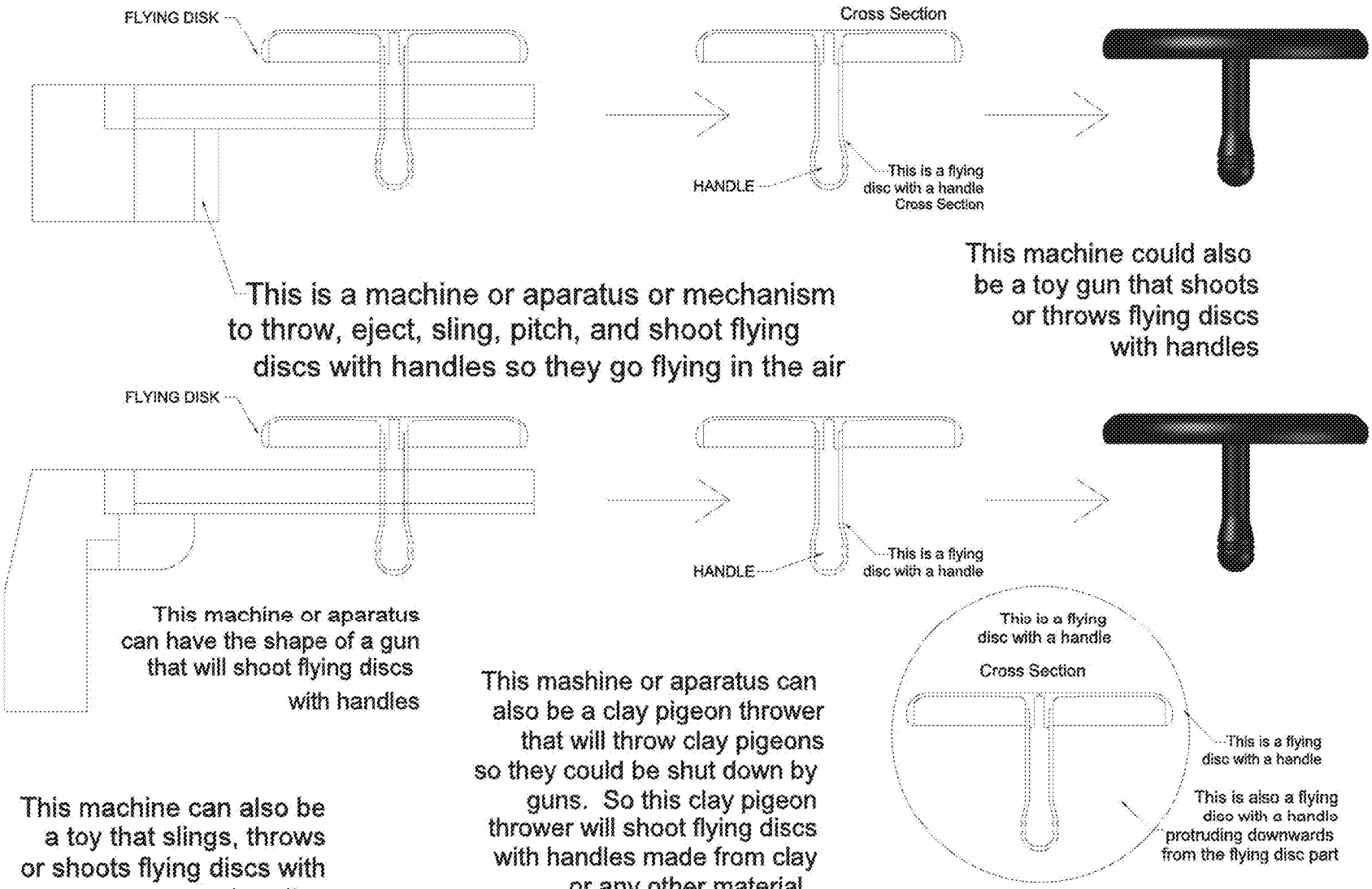
FIG. 11 includes several views of flying disks according to one or more embodiments of the present invention.

Referring to FIG. 11, these drawings show a machine, apparatus, or mechanism to throw, eject, sling, pitch, and shoot flying discs with handles so they go flying in the air. This machine can also be a toy gun that shoots or throws flying discs with handles. Because this machine or mechanism can pitch flying discs with handles. This machine or mechanism can be a pitcher that can pitch a flying disc with a handle for the use in baseball or softball. This machine can also be a toy that slings, throws or shoots flying discs with handles. This machine or apparatus can have the shape of a gun that shoots flying discs with handles. This machine or apparatus can also be a clay pigeon thrower that will throw clay pigeons so they could be shut down by guns. So, this clay pigeon thrower will shoot will shoot flying discs with handles made from clay or any other material. This machine or mechanism can be powered. This machine or mechanism can be motorized. This machine or mechanism can be powered by humans. By the human physical power.

Figure 12:
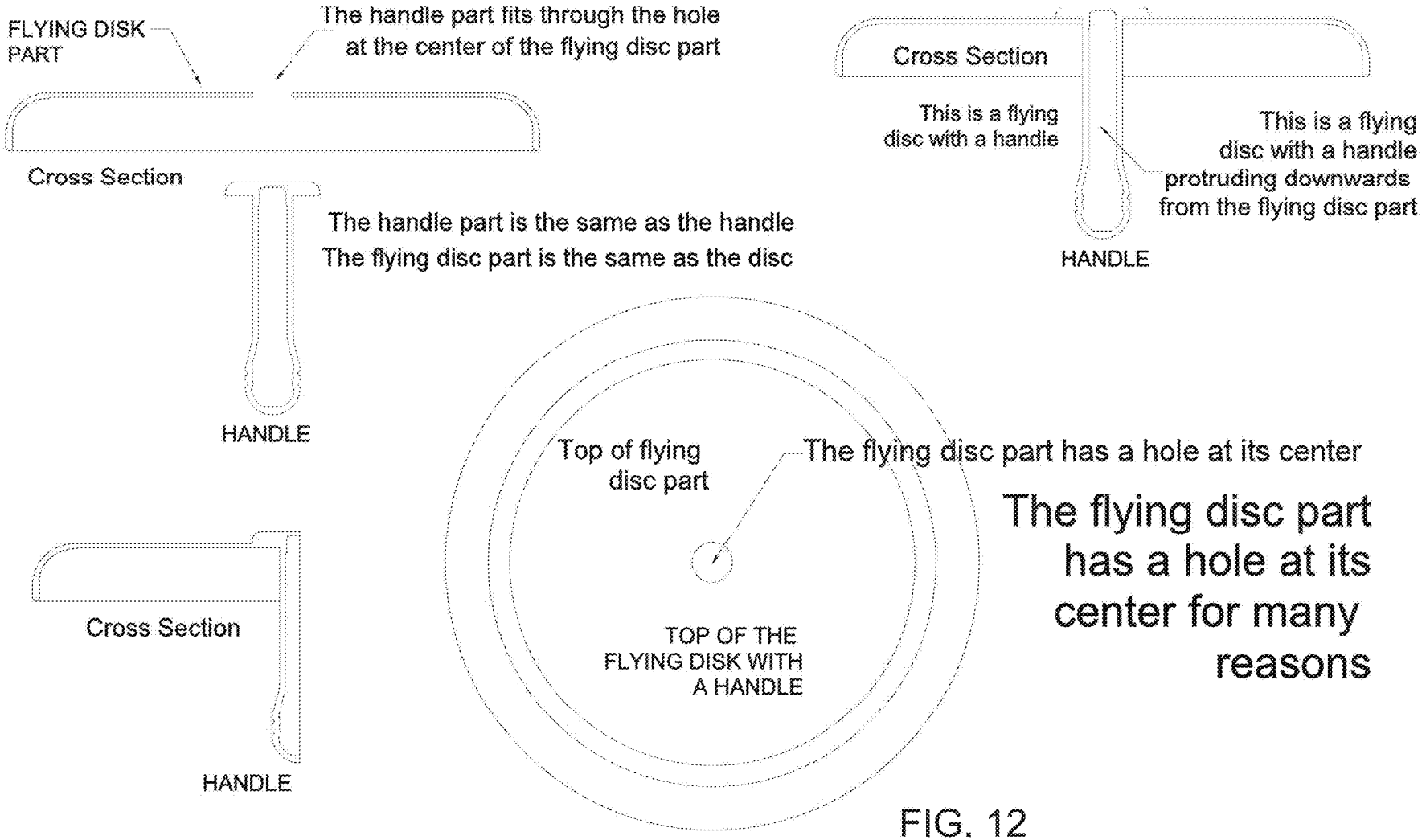
FIG. 12 includes several views of flying disks according to one or more embodiments of the present invention.

Referring to FIG. 12, these drawings show a flying disc part that has a hole in its center. This hole can be circular. The hole at its center can be there for many reasons. The handle part fits through a hole at the center of the flying disc part. The hole can be at the top center of the flying disc part. The top of the flying disc with a handle has a hole. The handle part top has a base that sits on top of the flying disc part. The handle sits at the center of the flying disc part with a hole.

Figure 13:
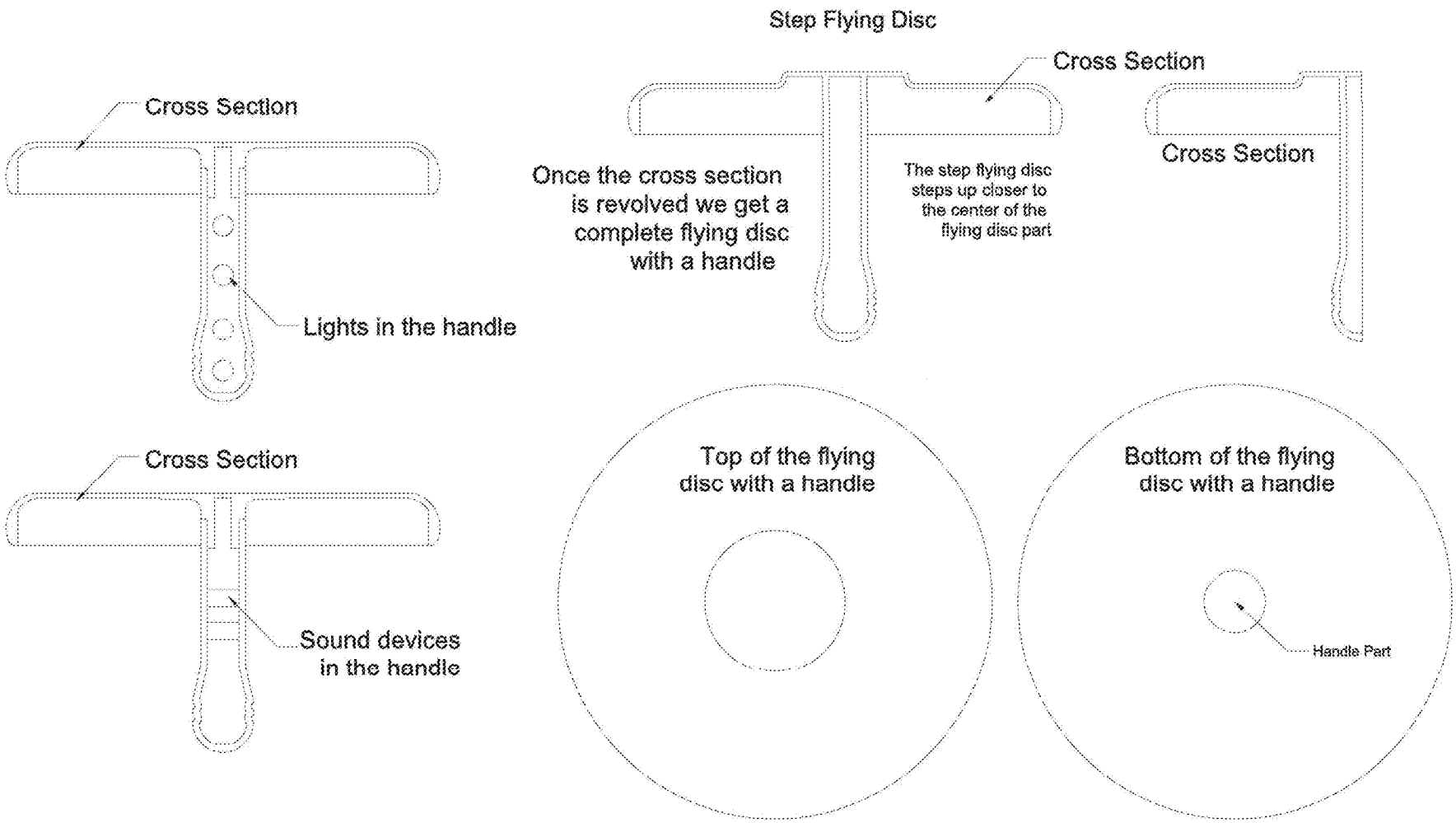
FIG. 13 includes several views of flying disks according to one or more embodiments of the present invention.

Referring to FIG. 13, these drawings show a flying disc with a handle that has lights in the handle part. These lights can go on and off, or stay on. The idea is to have a lit handle so it is easy to catch at night. The flying disc has sound devices in the handle part. Thus, the handle can emit sounds. The handle can play music. The handle can produce sound. There is a Step Flying Disc. This step flying disc part, steps up toward the center of the flying disc part, so you get another circular area on top of the flying disc circular part near the center of the flying disc top. So, you get a circle inside a circle when looked at from the top view.

Figure 14:
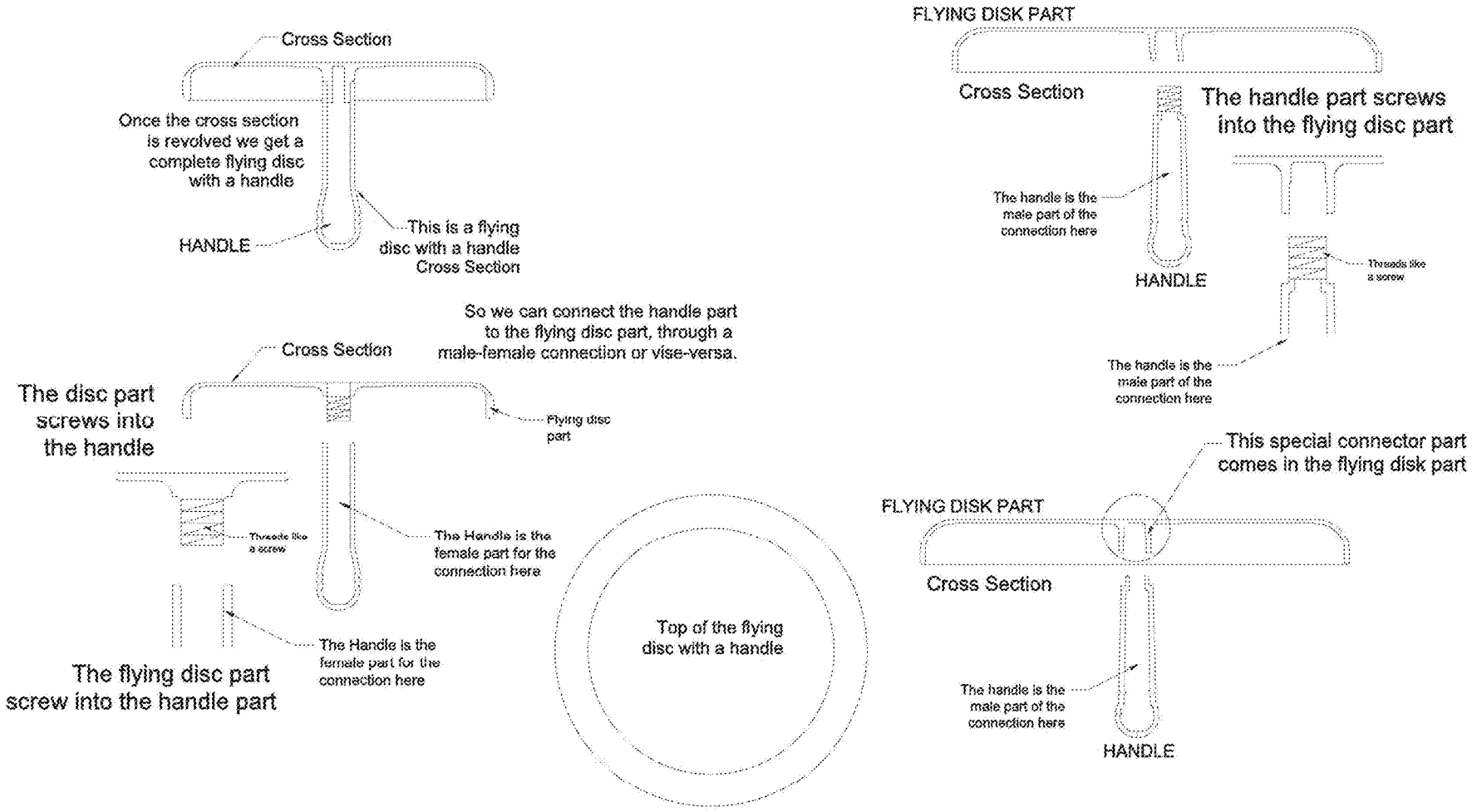
FIG. 14 includes several views of flying disks according to one or more embodiments of the present invention.

Referring to FIG. 14, these drawings show the flying disc with a handle can have a connection between the handle part and the flying disc part that uses threads for the connection. This means that the flying disc part screws into the handle part and visa-versa. Thus, the handle can screw into the flying disc part. The flying disc part can screw into the handle part. The flying disc with a handle protruding downwards from the center of the flying disc part can have a male-to-female connection to connect the handle part to the flying disc part. The flying disc with a handle protruding downwards from the center of the flying disc part can have a female-to-male connection to connect the handle part to the flying disc part. Thus, the flying disc with a handle can have a male-to-female connection and visa-versa.

Figure 15:
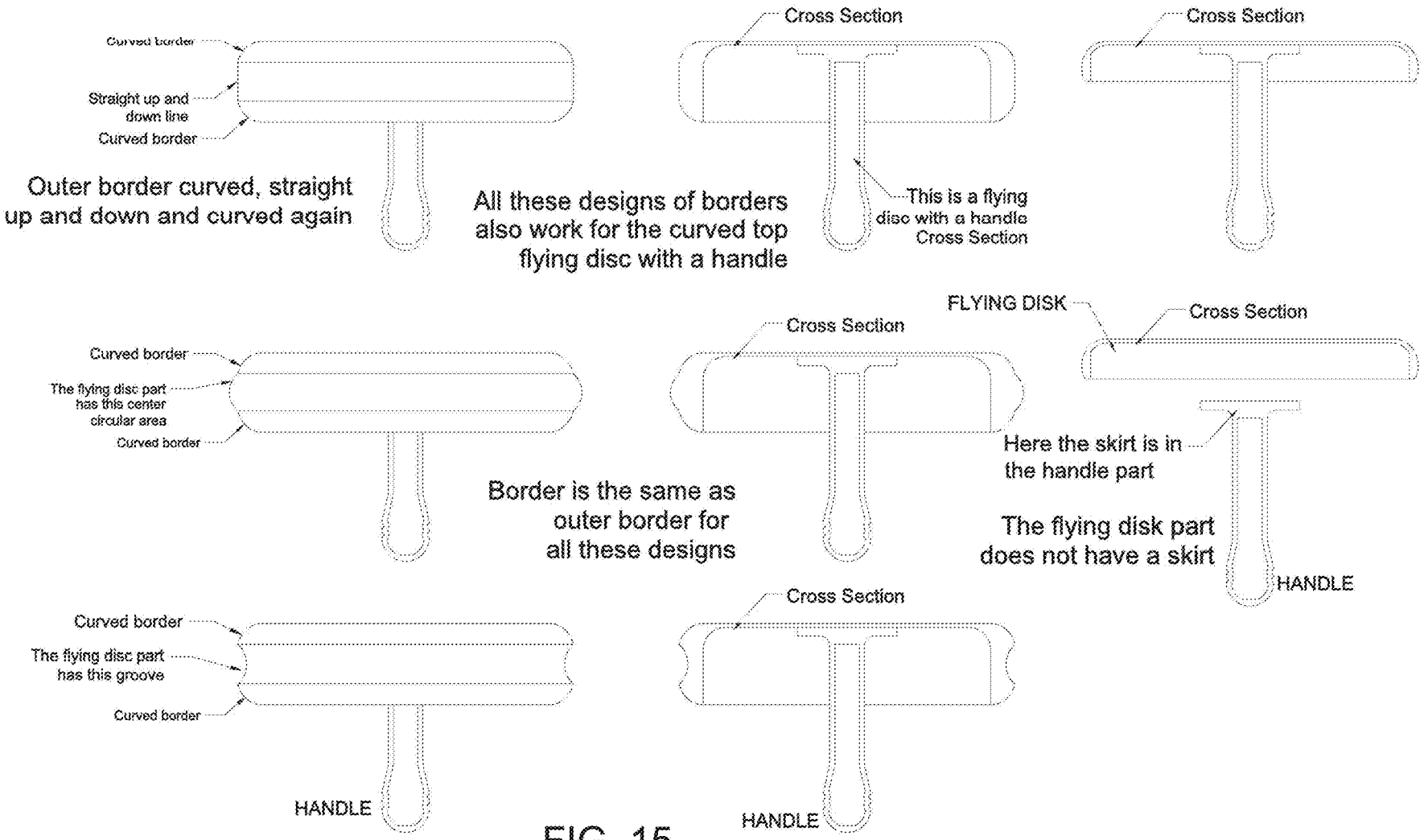
FIG. 15 includes several views of flying disks according to one or more embodiments of the present invention.

Referring to FIG. 15, these drawings show that the skirt can go on the handle part. In most of the cases the skirt goes on the flying disc part. Alternatively, the skirt can go on the handle part. And there is no skirt on the flying disc part. The flying disc part can have borders or edges that are rounded, straight and rounded. So, the straight part can be in the middle. If we look at the border of the flying disc part the top section can be rounded, the middle section can be straight, and the bottom section can be rounded.

Figure 16:
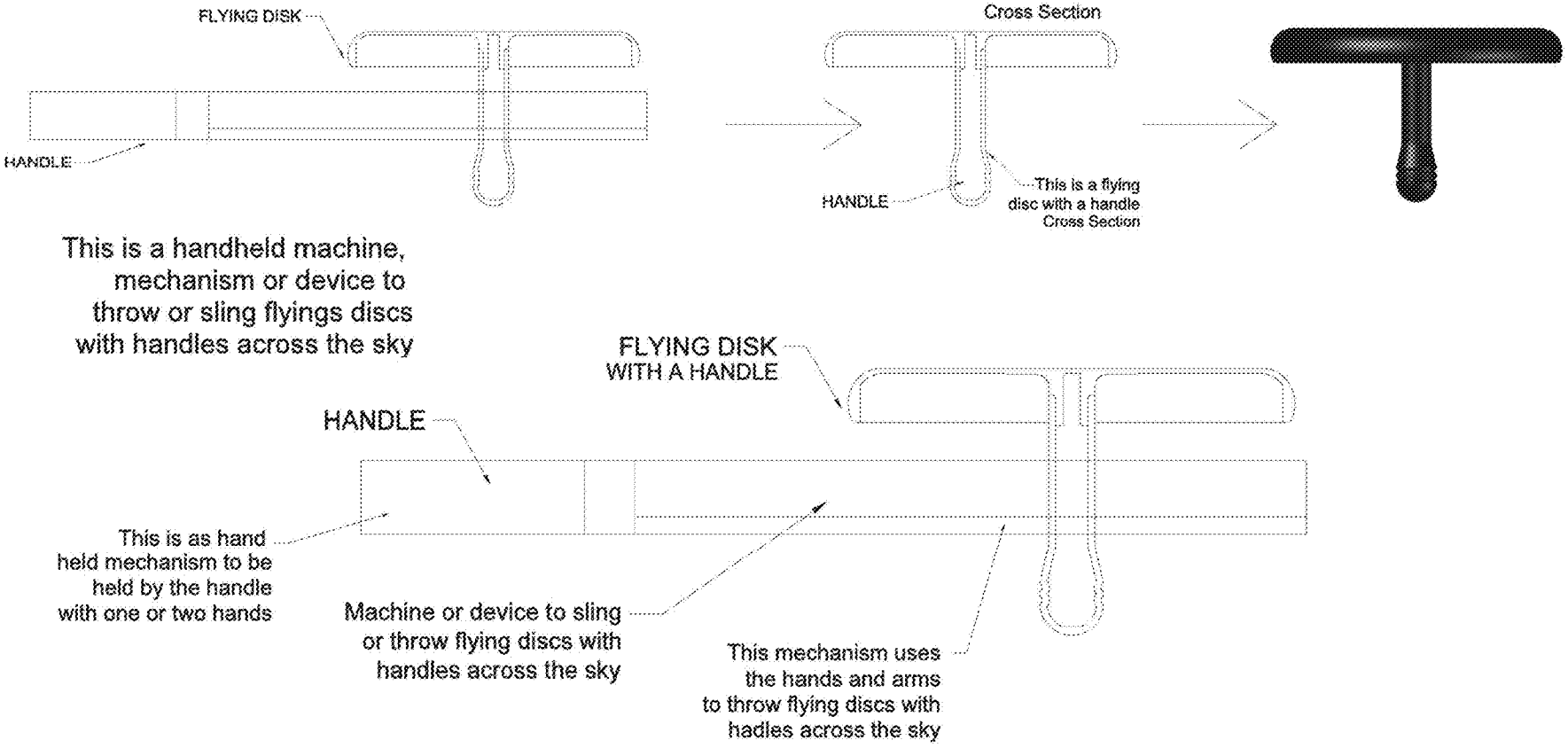
FIG. 16 includes several views of flying disks according to one or more embodiments of the present invention.

Referring to FIG. 16, these drawings show a hand-held mechanism that uses the hands and the arms to throw flying discs with handles across the sky. This can be a mechanism to be held by the handle with one or two hands. This mechanism or device can throw flying discs with handles across the sky by the use of human power. This mechanism contains a handle. All these inventions are a lot of fun!

Figure 17:
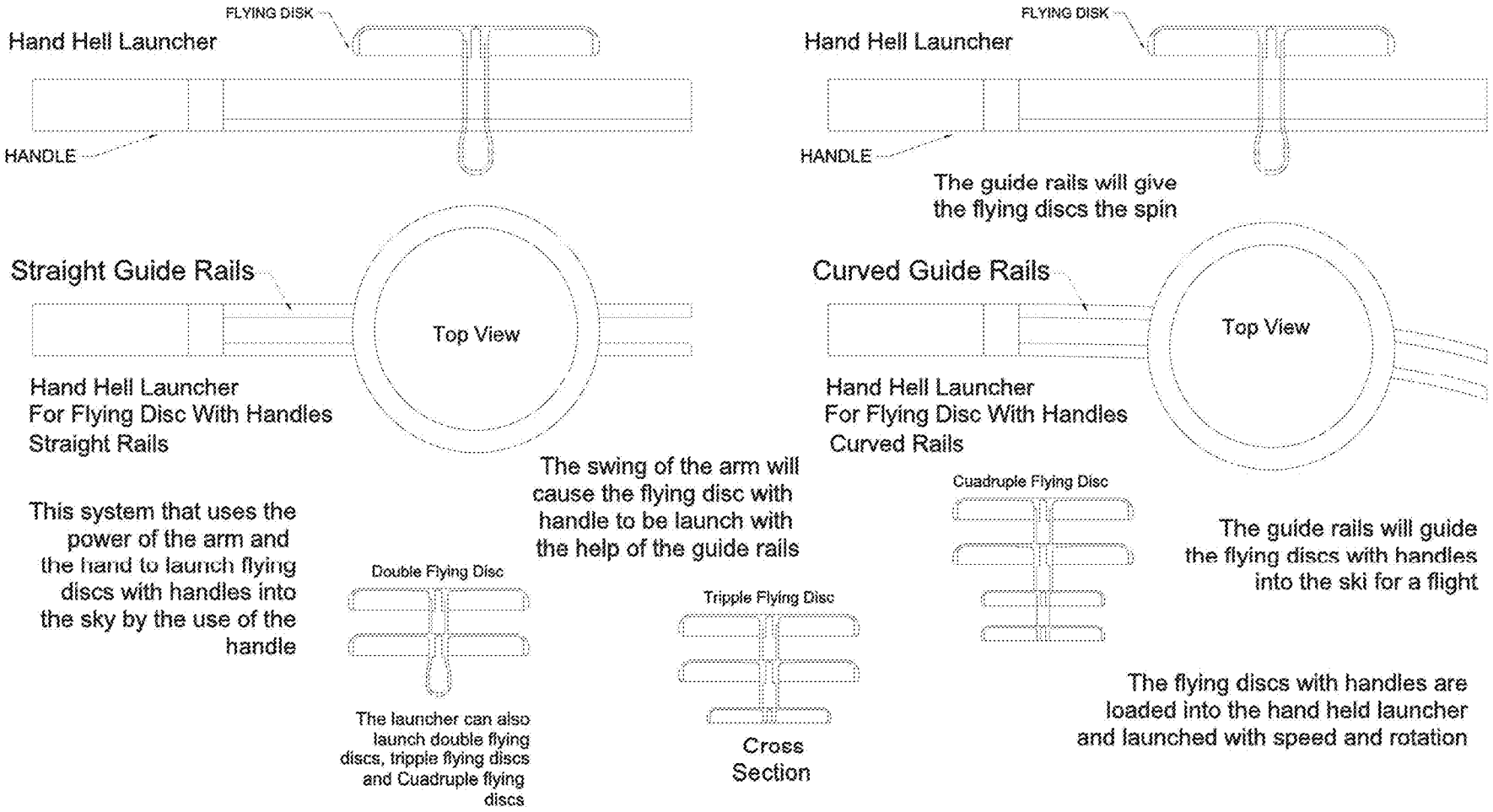
FIG. 17 includes several views of flying disks according to one or more embodiments of the present invention.

Referring to FIG. 17, these drawings show a hand-held launcher for a flying disc with a handle protruding downwards from the flying disc part. Or this can be a hand-held launcher for a flying disc with a handle. This launcher can also be adapted to launch double flying discs, triple flying discs, quadruple flying discs, etc. This hand-held launcher can also launch quintuple, sextuple, and more types of flying discs. Here quadruple is the same a cuadruple, and triple is the same as tripple. This hand-held launcher can have curved rails or straight rails. This launcher has a handle. The flying disc with handle can be loaded into the hand-held launcher. Then, by the swing of the arm the flying disc with the handle can be ejected out of the launcher. The flying disc with a handle can be adapted to travel through the rails and into the sky. This system uses the power of the arm and the hand to launch flying discs with handles. The launcher launches flying disc with handles with speed and rotation.

Figure 18:
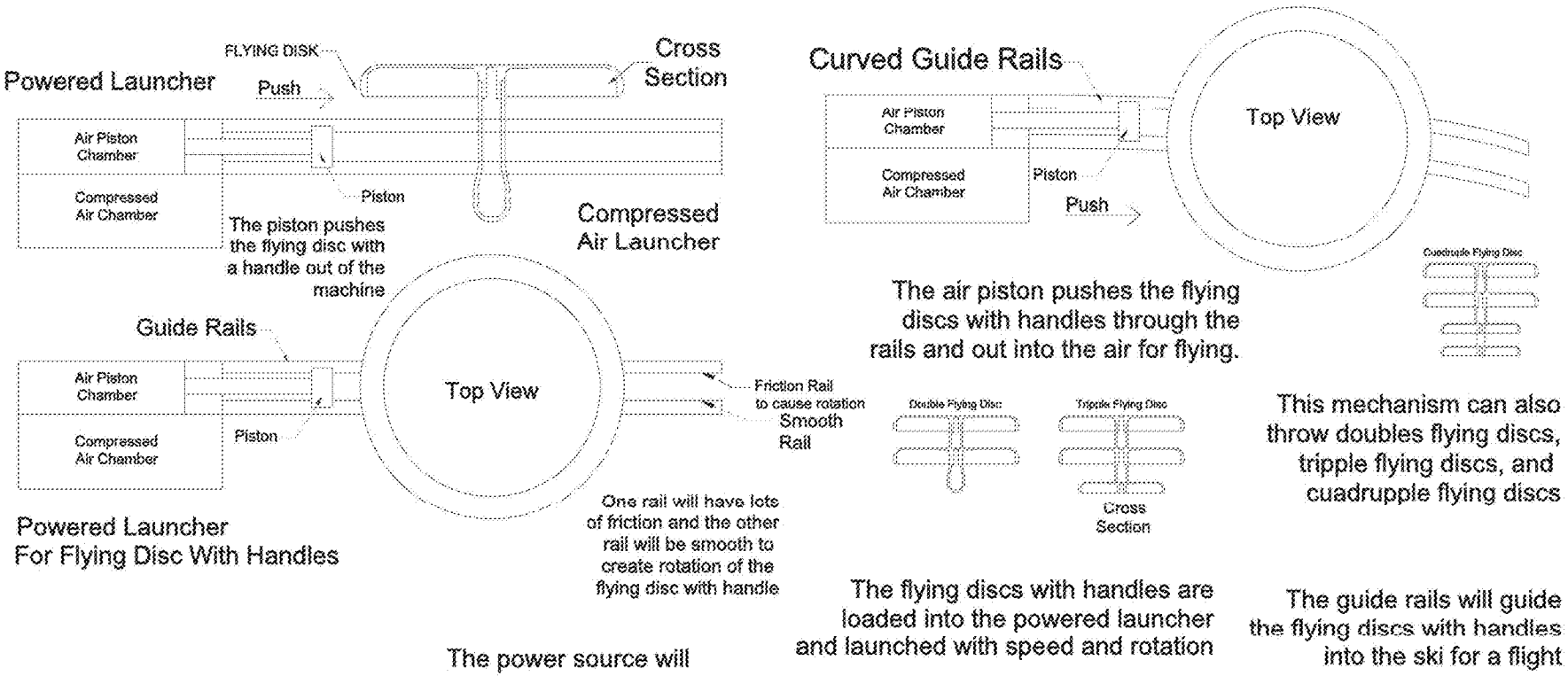
FIG. 18 includes several views of flying disks according to one or more embodiments of the present invention.

Referring to FIG. 18, these drawings show a power launcher. The power source for the launcher can be electric power and electrical motors. The power source can also be compressed air, springs, electric coil, bow power and more. Here source is the same as source. The flying disc with a handle can be loaded into the launcher. This launcher uses compressed air to launch the flying disc with a handle protruding downwards from the center of the flying disc part. The flying disc with a handle can be pushed through the rails and into the sky by the use of an engagement member (e.g., a piston). The piston can be pushed by the compressed air. Then, the piston pushes the flying disc with a handle out of the launcher. One rail of the launcher will be very smooth, and the other rail will have lots of friction. This combination will cause the flying disc with a handle to rotate, and be launched into the sky with speed and rotation. This launcher can have curved rails. This launcher can also be adapted to launch double flying discs, triple flying discs, quadruple flying discs, quintuple flying disc, sextuple flying disc with handle and more. Here quadruple is the same as cuadruple, and triple is the same as tripple. The guide rails will guide the flying disc with handle into the sky for flight. This launcher has a compressed air chamber.

Figure 19:
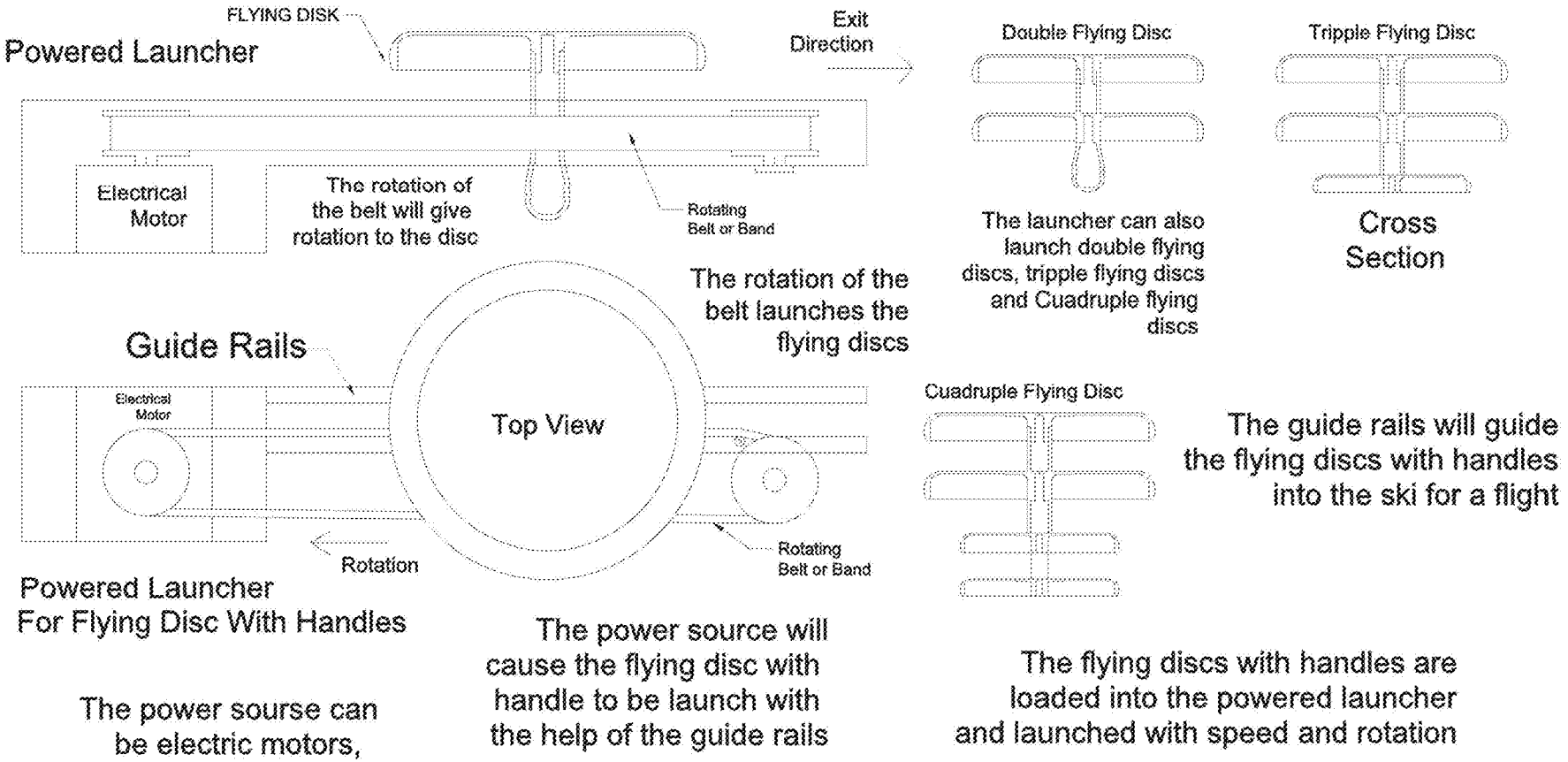
FIG. 19 includes several views of flying disks according to one or more embodiments of the present invention.

Referring to FIG. 19, these drawings show a power launcher. This power launcher uses electricity and an electrical motor for power. This power launcher makes a belt or band rotate. The flying disc with a handle can be loaded into the launcher. Then, the belt or band pulls the flying disc with a handle through the rails and into the sky for flight. The rotation of the belt or band will give rotation to the flying disc with a handle. The flying disc with a handle will exit the launcher with speed and rotation. The power source will cause the flying disc with a handle to launch with the help of guide rails. This launcher can be adapted to also launch double flying discs, triple flying discs, quadruple flying discs, quintuple flying discs, sextuple flying discs and more. The rotation of the belt or band launches the flying discs.

Figure 20:
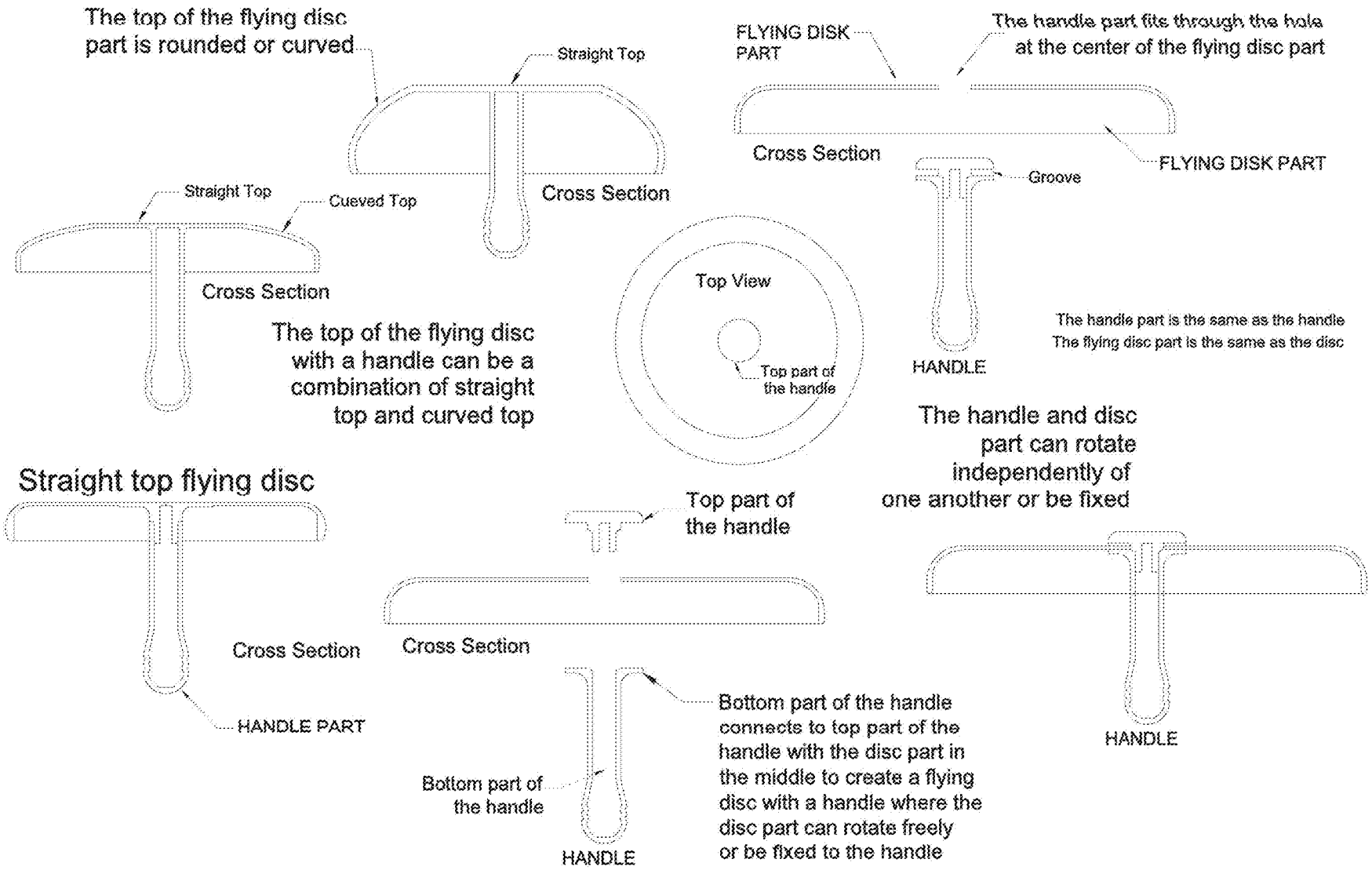
FIG. 20 includes several views of flying disks according to one or more embodiments of the present invention.

Referring to FIG. 20, these drawings show the top of the flying disc can be rounded or curved. Also, the top of the flying disc can be straight. There can be flying discs with handles that have a flying disc top that can be rounded or curved and another part that can be straight. There can be combination of straight top and curved top for the flying disc with a handle. Flying disc with a handle can be the same as flying disc with a handle protruding downwards from the center of the flying disc part. This figure also shows that the handle of the flying disc with a handle can be separated into two parts. The top part and the bottom part of the handle. The bottom part of the handle connects to the top part of the handle with the disc part in the middle of the two handle parts. The handle part fits through the hole at the center of the flying disc part. The handle part and the flying disc part can rotate independently from each other or be fixed to each other. So, the handle can have no movement while the disc part rotates. Or both parts can be fixed so they rotate equally. Also, a player can catch the flying disc with a handle by the handle, and the flying disc part can remain rotating, while the handle can be held firmly to a hand and not rotating. So, the flying disc part and the handle part can rotate independently of one another. Or, they can be fixed and rotate at the same time and stop at the same time.

Figure 21:
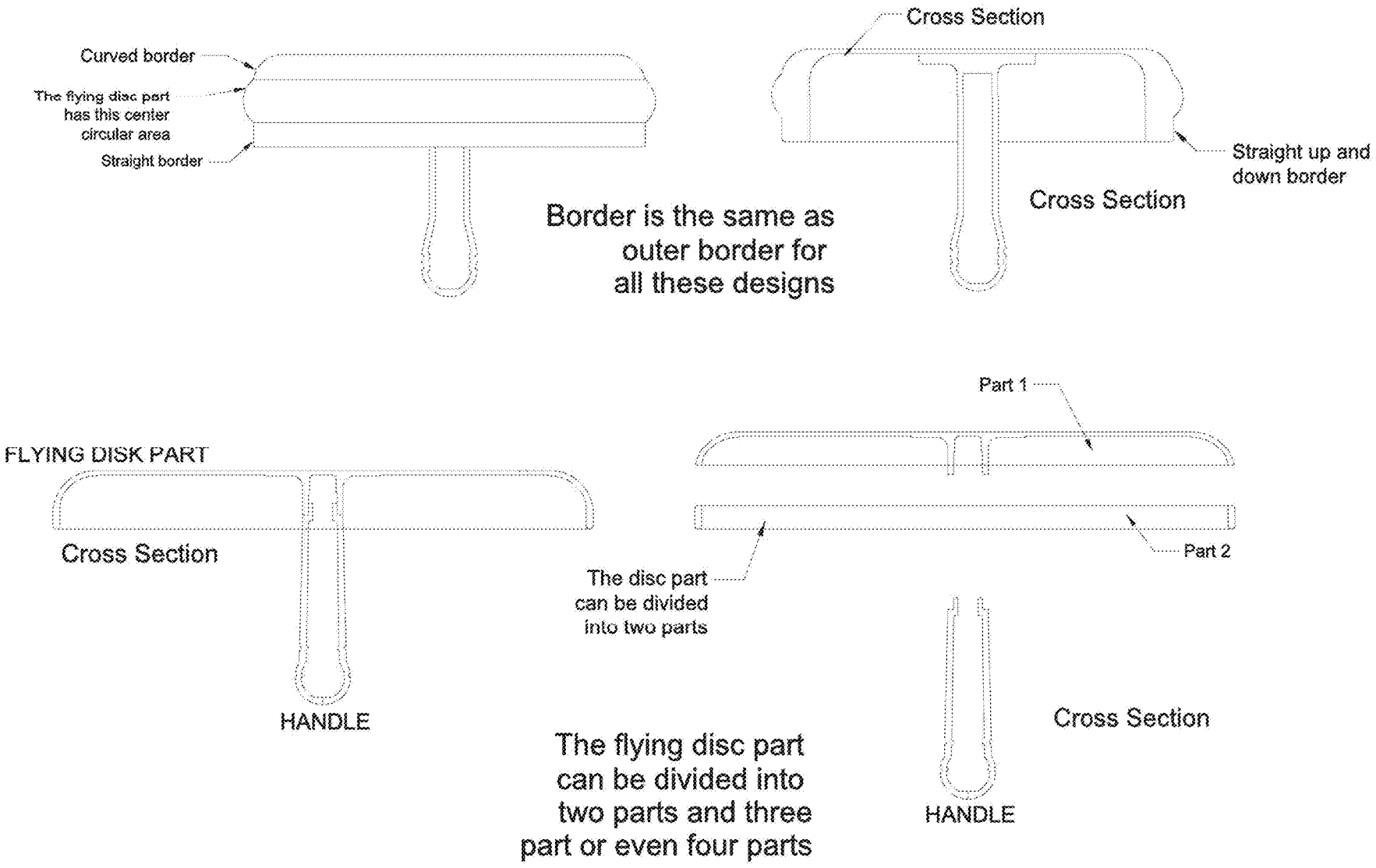
FIG. 21 includes several views of flying disks according to one or more embodiments of the present invention.

Referring to FIG. 21, these drawings show a flying disc with a handle that has a border that can be curved, circular, and straight. The top part of the disc border can be curved, and then curved again near the center or at the center and straight toward the bottom of the disc part. Thus, the border of the flying disc part can be straight, curved, and circular. This figure also shows that the flying disc part can be divided into two parts, part 1 and part 2. Also, the flying disc part can be divided into three parts, four parts, and more parts for the flying disc with a handle.

Figure 22:
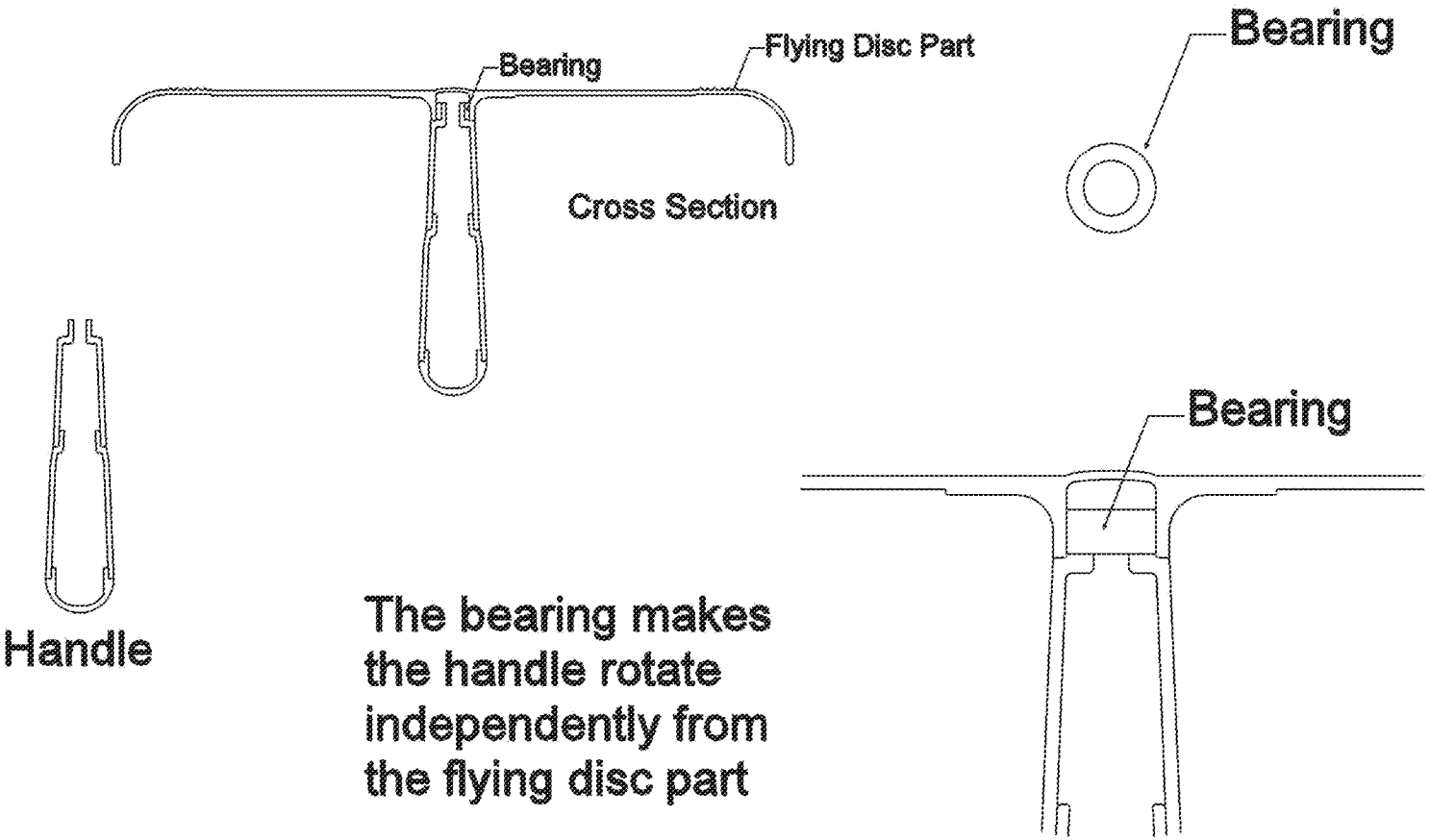
FIG. 22 includes several views of flying disks according to one or more embodiments of the present invention.

Referring to FIG. 22, these drawings show a flying disc with a handle that can incorporate a bearing. This bearing makes the flying disc part rotate independently from the handle or handle part. Furthermore, the bearing helps the handle rotate smoothly, independently from the handle, and for a longer period of time. Where you can be holding the handle tight with a hand, while the flying disc part rotates smoothly and independently from the handle part.

In one embodiment, a combination flying disc and handheld flying disc launching device can include, but is not limited to, a fly disc and a handheld flying disc launching device. The flying disc can be defined by a circular disk body having an upper surface, a lower surface, a downwardly extending perimeter rim, and a handle extending downwards from the center of the disk body. The handheld flying disc launching device can include a handle, a first rail, and a second rail. The first rail can have a first end coupled to the handle. The second rail can have a first end coupled to the handle. Further, the second rail can be (i) spaced apart from the first rail to receive the flying disc handle therethrough, and (ii) oriented substantially parallel to the first rail. A second end of the first rail and a second end of the second rail can form an opening for receiving and releasing the flying disc.

In one instance, an interior surface of the first rail can be rough and an interior surface of the second rail can be smooth. In another instance, an interior surface of the second rail can be rough and an interior surface of the first rail can be smooth. In yet another instance, an interior surface and a topside surface of the first rail can be adapted to create friction with the flying disc handle. A topside of the first rail and the second rail can each be smooth. A portion of the flying disc handle can be adapted to grip one of the first rail and the second rail. The handle of the handheld flying disc launching device can typically be oriented substantially in-line with the first rail and the second rail. In one instance, the handle of the handheld flying disc launching device can be oriented substantially perpendicular with the first rail and the second rail. In one embodiment, the first rail and the second rail can each be curved.

In one embodiment, a combination flying disc and powered flying disc launching device can include a flying disc and a powered flying disc launching device. The flying disc can be defined by a circular disk body having an upper surface, a lower surface, a downwardly extending perimeter rim, and a handle extending downwards from the center of the disk body. The powered flying disc launching device can include a power source, an engagement member, a handle, a first rail, and a second rail. The engagement member can be operatively coupled to the power source. The first rail and the second rail can each have a first end coupled to the handle. The second rail can be spaced apart from the first rail to receive the flying disc handle therethrough, and can be substantially parallel to the first rail. The engagement member can be adapted to engage and push the flying disc handle. The engagement member can be adapted to travel between and along a substantial length of the first rail and the second rail. In one instance, the power source can be compressed air. In another instance, the power source can be an electric motor. In yet another instance, the power source can be a compression spring. Typically, the power source can be integrated into the handle of the powered flying disc launching device.

In one embodiment, a combination flying disc and handheld flying disc launching device can include a flying disc and a handheld flying disc launching device. The flying disc can be defined by a circular disk body having a handle extending downwards from a center of the disk body. The handheld flying disc launching device can include a handle and a pair of guide rails coupled to the handle. The handheld flying disc launching device can be adapted to launch the flying disc. The pair of guide rails can be spaced apart to receive the handle of the flying disc therethrough. In one instance, an interior surface of one of the pair of guide rails adapted to interface with the handle of the flying disc can be rough. The handle of the flying disc can include a bulge on a distal end of the handle. A width of the bulge can be greater than a gap between the pair of guide rails.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A combination flying disc and handheld flying disc launching device comprising:

a flying disc defined by a circular disk body having an upper surface, a lower surface, a downwardly extending perimeter rim, and a handle extending downwards from the center of the disk body; and a handheld flying disc launching device including:

a handle;

a first rail having a first end coupled to the handle; and a second rail having a first end coupled to the handle, the second rail (i) spaced apart from the first rail to receive the flying disc handle therethrough, and (ii) being substantially parallel to the first rail;

wherein a second end of the first rail and a second end of the second rail form an opening for receiving and releasing the flying disc.

2. The combination of claim 1, wherein an interior surface of the first rail is rough and an interior surface of the second rail is smooth.

3. The combination of claim 1, wherein the downwardly extending perimeter rim includes a first portion, a second portion, and a third portion.

4. The combination of claim 3, wherein (i) the first portion and the third portion have approximately equal curvatures, and (ii) the second portion has a different curvature from the first portion and the third portion.

5. The combination of claim 1, wherein the handle of the handheld flying disc launching device is oriented substantially in-line with the first rail and the second rail.

6. The combination of claim 1, wherein the handle of the handheld flying disc launching device is oriented substantially perpendicular with the first rail and the second rail.

7. The combination of claim 1, wherein a topside of the first rail and the second rail are each smooth.

8. The combination of claim 1, wherein an interior surface and a topside surface of the first rail are adapted to create friction with the flying disc handle.

9. The combination of claim 1, wherein the first rail and the second rail are each curved.

10. A combination flying disc and handheld flying disc launching device comprising:

a flying disc defined by a circular disk body having a handle extending downwards from a center of the disk body; and a handheld flying disc launching device adapted to launch the flying disc, the handheld flying disc launching device including:

a handle;

a pair of guide rails coupled to the handle, the pair of guide rails spaced apart to receive the handle of the flying disc therethrough.

11. The combination of claim 10, wherein an interior surface of one of the pair of guide rails adapted to interface with the handle of the flying disc is rough.

12. The combination of claim 10, wherein the handle of the flying disc includes a bulge on a distal end of the handle.

13. The combination of claim 12, wherein a width of the bulge is greater than a gap between the pair of guide rails.

* * * * *